US007658639B2

(12) United States Patent
Hoppmann

(10) Patent No.: US 7,658,639 B2
(45) Date of Patent: Feb. 9, 2010

(54) TERMINAL BLOCK

(75) Inventor: Ralph Hoppmann, Minden (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 53 days.

(21) Appl. No.: 12/090,595

(22) PCT Filed: Oct. 19, 2006

(86) PCT No.: PCT/EP2006/010092

§ 371 (c)(1),
(2), (4) Date: Apr. 17, 2008

(87) PCT Pub. No.: WO2007/045473

PCT Pub. Date: Apr. 26, 2007

(65) Prior Publication Data

US 2008/0233782 A1 Sep. 25, 2008

(30) Foreign Application Priority Data

Oct. 20, 2005 (DE) ..... 10 2005 050 267

(51) Int. Cl.
*H01R 11/20* (2006.01)

(52) U.S. Cl. ..... 439/409; 439/259; 439/142; 439/718; 439/892

(58) Field of Classification Search ..... 439/259, 439/395, 409, 410, 417, 135, 142, 149, 709, 439/716, 718, 892, 893
See application file for complete search history.

(56) References Cited

U.S. PATENT DOCUMENTS

| | | | | |
|---|---|---|---|---|
| 3,757,281 | A * | 9/1973 | Woertz et al. | 439/724 |
| 5,810,625 | A | 9/1998 | Klein et al. | |
| 6,217,361 | B1 * | 4/2001 | Murr | 439/342 |
| 2005/0079773 | A1 | 4/2005 | Prokup et al. | |
| 2008/0233782 | A1 * | 9/2008 | Hoppmann | 439/259 |

FOREIGN PATENT DOCUMENTS

| | | |
|---|---|---|
| EP | 1130685 | 9/2001 |

OTHER PUBLICATIONS

International Search Report for PCT/EP2006/010092, Jan. 29, 2007, EPO.

* cited by examiner

*Primary Examiner*—James Harvey
(74) *Attorney, Agent, or Firm*—Bourque and Associates, PA

(57) ABSTRACT

The optical reduction of openings (12) in insulating housings (2) of terminal blocks (1) and an external characterization (23) of said series terminals, is achieved by terminal blocks being provided with conductor connection elements (4). The respective actuating opening of each contact point, which is used to receive actuating tools, is closed by means of a flap (17) provided with an integral hinge, the flaps forming a common surface with the insulated housing. Said flaps can include a visible feature or indicia on the surface thereof, characterizing the type of connection element.

10 Claims, 3 Drawing Sheets

TERMINAL BLOCK

TECHNICAL FIELD

The invention generally relates to an insulating housing for screwless electrical terminals, particularly electrical series terminals configured to engage with collector rails that are equipped to receive electrical conductors with modern connector-connection elements such as spring-force terminals.

BACKGROUND INFORMATION

Electrical terminals with springs have in common the fact that they, as a rule, are connection terminals, i.e., that they include two draw springs each that are electrically connected together via an electrically-conducting connection rail (contact piece). Further, such terminals possess conductor-insertion apertures and actuation apertures for insulating housing for series terminals that are usually located on the front side of the series terminals for front wiring. The upper side of the terminal is that side of a conventional embodiment form which is missing the installation foot usually provided for engagement with a carrier rail.

Such insulating housings for screwless electrical terminals with conductor-insertion apertures and actuation apertures for the insertion of a tool to open the conductor connection elements are generally known from the State of the Art. In particular, there are known insulating housings that have actuation apertures that serve first as a guide channel to release tools and second as insertion apertures for conductors to be connected and that allow insertion and extraction of the conductor for the conductor-guide channel. The tool is usually an insulated screwdriver that, when inserted, enables the opening of the terminal (release of the conductor) for the pertinent conductor by means of a levering action or pressure on the conductor-connection element. Such an electrical terminal with a terminal-spring connection that ensures positive actuation in a simple fashion using an actuation tool is revealed in DE 196 02 945 A1.

It is known from DE 24320084 A1 for the insulating housing to include a conductor-insertion and actuation aperture. The terminal leg of the spring terminal is pivoted by means of the tool inserted through the actuation aperture.

Further developments of the actuation aperture may be taken from DE 94 14939 U1. To protect the conductor-connection element from damage by the actuation tool, the insertion channel possesses a moveable insulating wall on its lower end. Under that condition, the safety of the operator may be ensured during insertion of a metallic tool.

Screwless electrical series terminals of various designs, for example Spring Terminal Spring-pressure series modules, are known under the name "CLIPLINE" from the product catalog "Innovationen in Interface" TNR S 114674/01.05.00-00 of the company Phoenix Contact GmbH & Co, Blomberg, Germany. Such terminals include conductor-insertion and actuation apertures.

All embodiment types of the State of the Art have in common the fact that the actuation apertures are positioned to be frontally accessed but relatively close adjacent to, or behind, the conductor-insertion apertures. The installer thus has the best view of the connection points during connection of the electrical conductors. There are also embodiment examples where narrow test apertures for a voltage tester are located between the conductor-insertion apertures and the actuation apertures. See DE 94 14 939 U1 for an example.

A disadvantage for screwless electrical series terminals is the large number of apertures that result, especially when a large number of series terminals are to be mounted on a common rail in line and/or in a three-level embodiment. Confusion of conductor-insertion apertures and the actuation apertures may occur during insertion of electrical conductors to be connected, or during operation of the spring-force terminal.

A further disadvantage is the fact that series terminals with similar external appearance may be equipped inside the insulating housing that possesses differing conductor-connection elements, which is hard to recognize from without. The differing conductor-connection elements may, for example, consist of cage, loop, pivot, or sheet springs.

It is therefore the task of the invention to present a technical solution that allows a reduction of the large number of apertures of screwless electrical series terminals and to present the installer with optical assistance by placing only apertures of conductors to be connected on the upper side of the series terminal, whereby actuation apertures for the spring-force terminals using a screwdriver remain concealed.

SUMMARY

In order to create a series terminal that may be snapped together on common rails that possesses these characteristics of the invention, it is recommended that an insulating housing be used for which the actuation apertures are formed in the housing so that they may be closed by a flap, and that the flap forms a common surface together with the insulating housing. The flap closes the entrance of the actuation aperture optically appearing as one piece with the insulating housing whereby the flap itself is made of insulating material, preferably of the same material as the insulating housing.

The flap to close the actuation aperture is matched to the shape of the actuation aperture. As a rule, the shape of the actuation aperture is square or rectangular, whereby other aperture shapes are conceivable.

In order to insert a screwdriver as the actuation tool into the actuation aperture of the series terminal to actuate the conductor-connection element, the flap is moveably mounted on the insulating housing. The movement capability of the flap is achieved by means of a film hinge. The film hinge represents the moveable connection between the insulating housing and the flap. The film hinge is located across from the side facing away from the conductor-connection aperture.

In order to unlatch or plug the electrical conductor, the flap is opened by the insertion of the actuation tool. During this, the flap pivots downward and is pressed into the actuation aperture. After actuation of the conductor-connection element and the removal of the actuation tool, the flap automatically returns to its initial position, thereby closing the actuation aperture. The original position is achieved by means of by engaging media mounted on the edge of the actuation aperture in the insulating housing. The engagement for the flap may consist of a slot or projecting rib or concave space on the edge of the actuation aperture. The flap possesses a slot or projecting rib as its engaging media similar to the engaging media in the actuation aperture. The actuation aperture preferably is formed with a slot for engagement. The engaging medium on the flap is located on the opposite side of the film hinge, and represents a releasable engagement in the actuation aperture. Other engagement media such as small blind holes and correspondingly-assigned small nipples or opposing engaging noses for the releasable engagement between the flap and the actuation aperture are conceivable.

If similarly-appearing series terminals are equipped with different conductor-connections and the installer is to be able optically to distinguish them, it is recommended by the invention to equip an entire model with spring-force terminals with the flap based on the invention within the insulating housing and to leave alone all models with screw terminals. Another alternative would be to equip all models of series terminals with spring-force actuation with the flap based on the invention within the insulating housing and thus provide an optical differentiation form series terminal with screw terminals. Also, the flaps may be of different shapes and thus provide a hint using a corresponding designation on the upper surface of the flap regarding which spring-force terminal element is located within the series terminal. This designation may consist of a characteristic formed on the top of the flap using an injection-molding process. The designation may consist of various symbols that differentiate the different models. The surfaces of the flaps on the insulating housing may also be color-coded to differentiate the models. Other forms of designation are conceivable.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
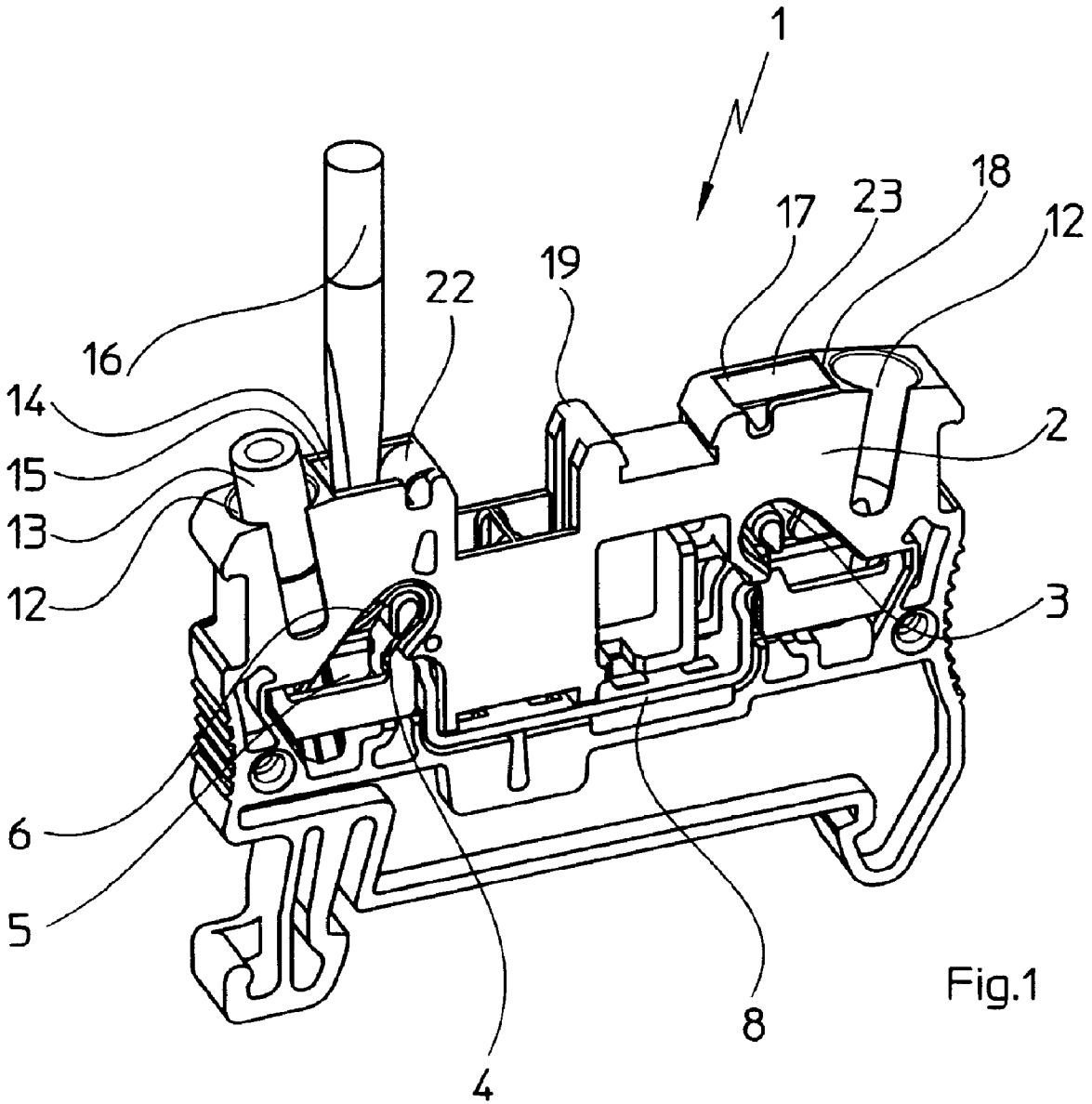
FIG. 1 is a perspective view of a series terminal in accordance with the present invention.
Figure 2:
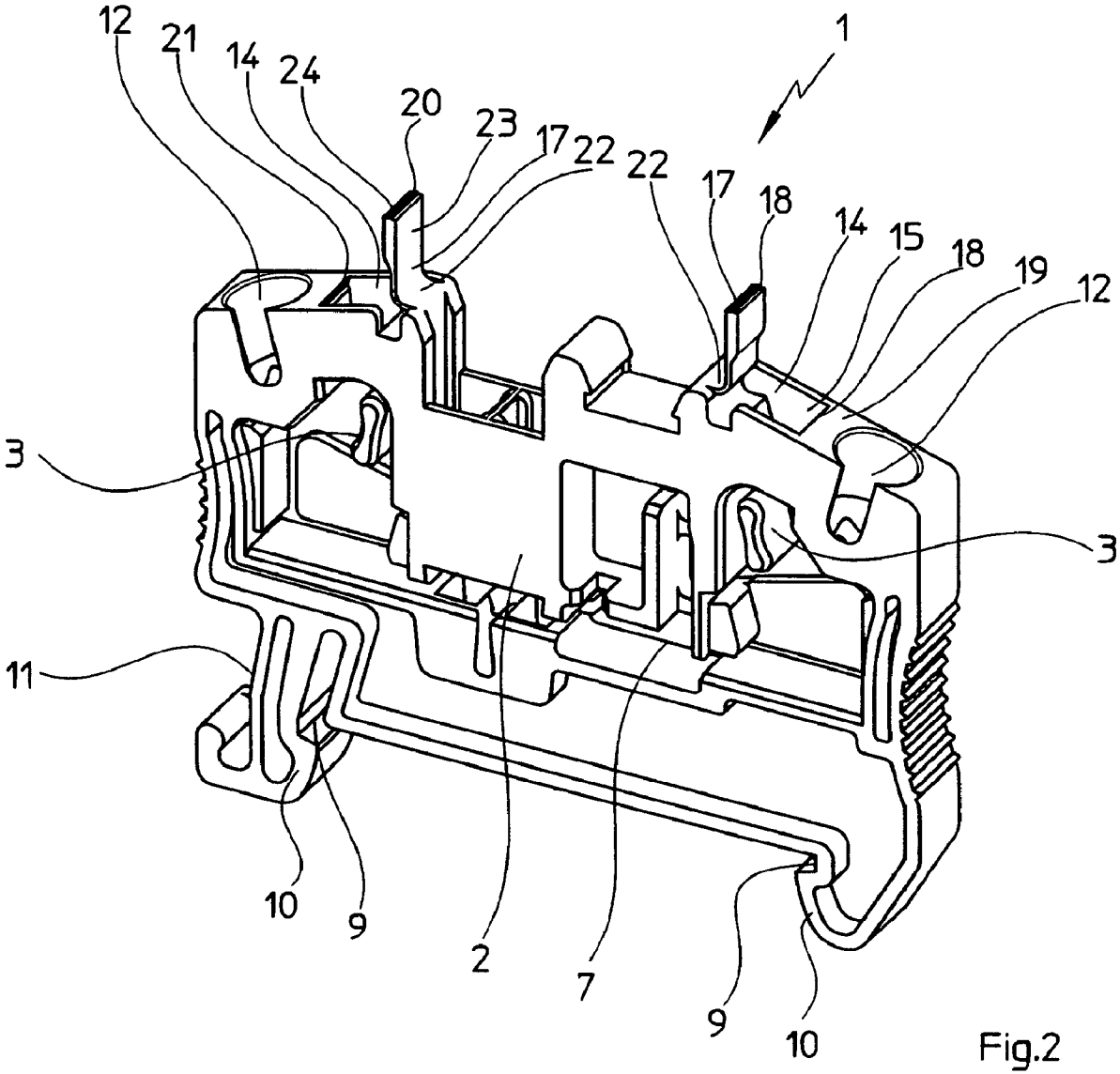
FIG. 2 is a perspective view of an insulating housing with opened flaps and engagement media according to the present invention.
Figure 3:
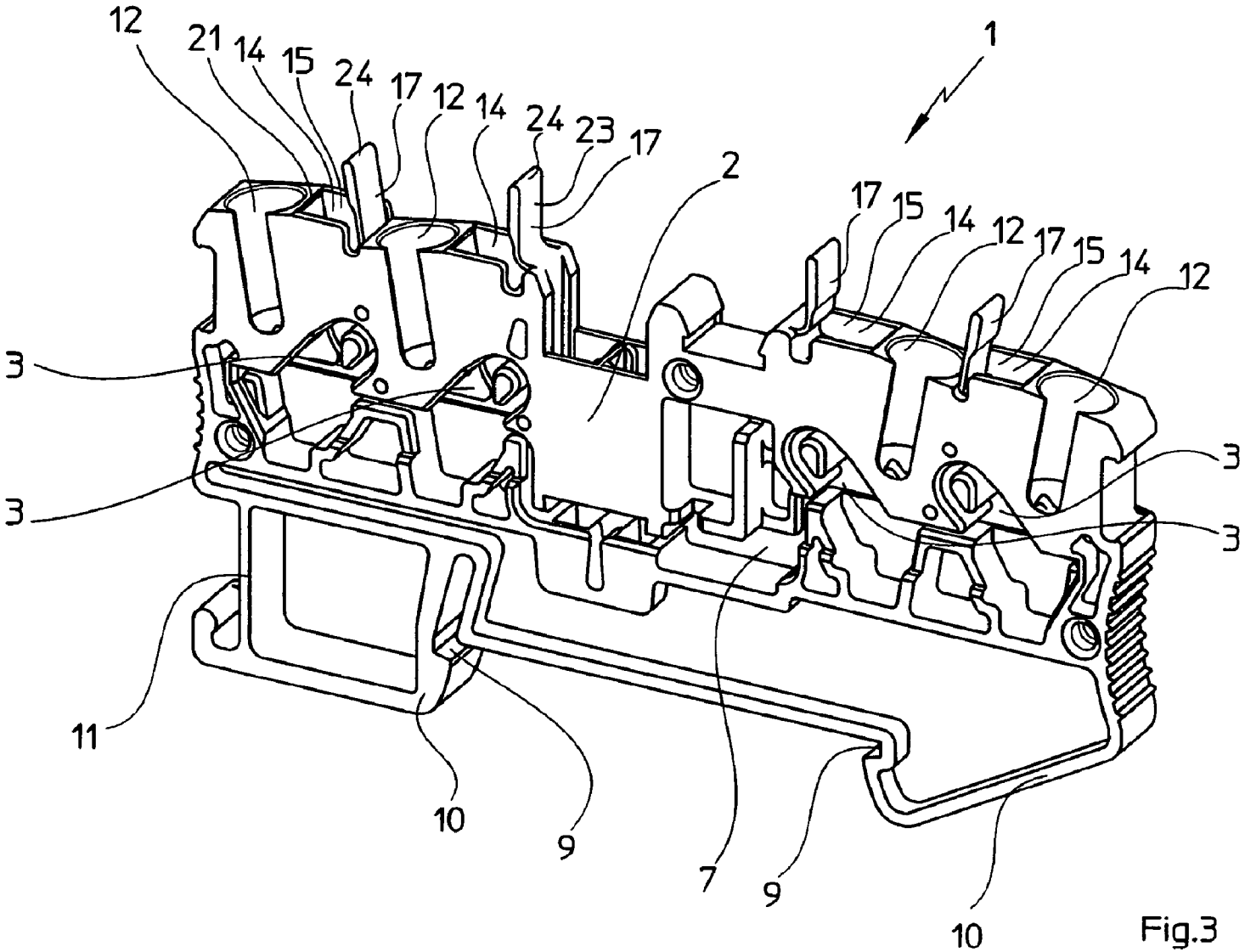
FIG. 3 is a perspective view of an insulating housing in twin configuration for double connections with opened flaps and engagement media in accordance with the present invention.

For the series terminal 1 shown in perspective view in FIGS. 1 through 3, an insulating housing 2 is shown that is provided with various apertures. Apertures 9 between the legs 10 in the bearing foot 11 serve first to secure the series terminal 1 to a common rail or base rail (not shown), and apertures 3, 7 that second serve to receive conductor-connection elements 4, for example in the form of screwless connection terminals and the connecting rail 8 or contact piece, are present within the insulating housing 2. Additional apertures in the insulating housing 2 consist of the conductor-insertion aperture 12 and the actuation aperture 14.

FIG. 1 shows a series terminal 1 configured with connection terminals consisting of an insulating housing 2, with an electrical conductor 13, a conductor-connection element 4, a connection rail 8, and an actuation tool 16. The series terminal 1 serves to receive the electrical conductors 13, and is frontally accessible, i.e., the electrical conductor 13 and the actuation tool 13 come from the same direction. For this, the series terminal 1 possesses conductor-insertions 12 and actuation apertures 14. The aperture 3 to receive the conductor-connection element 4 is located below the conductor-insertion aperture. The connection terminal 4 inserted into the aperture 3 may consist of a cage pull spring or a pivot spring. For example, FIG. 1 shows a connection terminal 4 formed as a pivot spring that is suited to receive the electrical conductor 13 inserted through the conductor-insertion aperture 12 and to clamp it.

With pivot springs, an actuation aperture 14 and an actuation channel 15 are required to open the contact point. Normally, this actuation aperture 14 for the insertion of an actuation tool 16 is located on the upper side 21 of the series terminal 1.

Based on the invention, the actuation aperture 14 of the actuation channel 15 is closed by a flap 17. To open the spring-force element 4, it is therefore required for a screwdriver blade to be inserted as a tool 16 into the actuation channel 15. When the tool 16 is inserted along a direction parallel to the electrical conductor 13, the tip of the tool 16 strikes the closed flap 17 of the insulating housing 2, whereby the flap 17 of the insulating housing 2 is slightly pressed out of the displacement path of the tool 16 using optimal conversion of the force to open the flap 17 into the actuation channel 15. Because of the force applied with the tool 16 to the flap 17, the engagement media 18 release the flap 17 and bends it into the actuation channel 15. This flexibility of the flap 17 is achieved by the film hinge 22 located on the flap 17. This film hinge 22 is mounted on the actuation aperture 14 of the insulating housing 2 perpendicular to the longitudinal side and parallel to the narrow side. i.e., the flap 17 is connected with the insulating housing 2 by means of the film hinge 22, and preferably consists of the same insulating material as the insulating housing 2 of the series terminal 1. In FIGS. 1 through 3, the flap 17 is mounted on the actuation aperture 14 as seen from the top view of the narrow side of the insulating housing 2 and behind the conductor-insertion aperture 12 and the square or rectangular actuation aperture 14 so that it may move by means of the film hinge 22. If the tip of the tool 16 is further pressed into the actuation channel 15, then the terminal leg 6 of the spring-force terminal 4 is pressed away, whereby the contact point 5 is opened, either to insert the electrical conductor 13 into the contact point 5 or to release a clamped electrical conductor 13 again out of the contact point 5.

When the tool 16 is removed from the insulating housing 2 of the series terminal 1 by removing the tool 16 from the actuation channel 15, the flap 17 swings automatically returning to its initial position, thus sealing the actuation aperture 14 of the actuation channel 15 of the insulating housing 2 on the upper side 19 of the series terminal 1. This closing of the actuation aperture 14 is performed by means of the engagement media 18 mounted on the flap 17 and on the actuation aperture 14. The engagement media 18 are described and shown in greater detail in FIGS. 2 and 3.

For optical determination of similar series terminals 1 that are configured with different conductor-connection elements within the insulating housing 2, the closed flap 17 is labeled with a symbol or label 23 on the visible upper surface 19. The label 23 of the label may consist of letters that, for example, are raised or lowered with respect to the surface of the flap. For this, letters or pictogram symbols such as an image of a screwdriver may be used.

FIG. 2 shows an insulating housing 2 with two conductor-insertion apertures 12 and two actuation apertures 14, whereby the flaps 17 of the actuation apertures 14 are shown in an open position for better clarity. Because the film hinge 22 is mounted on the insulating housing 2 to secure the flap 17, the flap 17 may also pivot upward. So that the flap 17 cannot pivot in both directions upward and downward, a slot 21 or ridge is positioned immediately below the edge of the actuation 14 within the actuation channel 15 as engagement media 18. The slot 21 within the actuation channel 15 is located on the side facing toward the conductor-insertion aperture 12. The engagement media 18 forms the opposing piece to the slot on the narrow surface of the flap 17 perpendicular to the surface 19 that consists of a rib 20. If the two engagement media 18 (slot 21 and ridge 20) come into contact, then the actuation 14 is sealed closed by means of the flap 17 with the surface 19 of the insulating housing 2. The flap 17 is thus located in its initial position (see FIG. 1).

One may see from FIG. 3 that the insulating housing 2 for the series terminal 1 with double connections may be closed by the flap 17 in order to reduce the quantity of apertures 14. As engagement media 18, the flaps 17 possess a crowned face surface 24. When the actuation 14 is closed, the crowned face surface 24 engages with the engagement media 18 of the actuation channel 15 of the ridge 19 when the actuation aperture 14 is closed.

The present invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention, which is not to be limited except by the allowed claims and their legal equivalents.

| Reference Index list | |
|---|---|
| 1. | Screwless electrical connector |
| 2. | Insulating housing |
| 3. | Aperture for conductor-connection element |
| 4. | Conductor-connection element (spring-force terminal) |
| 5. | Contact point |
| 6. | Loop part |
| 7. | Aperture for connector rail |
| 8. | Connector rail (contact part) |
| 9. | Apertures for common rails (base rails) |
| 10. | Leg |
| 11. | Base foot |
| 12. | Conductor-insertion aperture |
| 13. | Electrical conductor |
| 14. | Actuation aperture |
| 15. | Actuation channel |
| 16. | Actuation tool |
| 17. | Flap |
| 18. | Engagement media |
| 19. | Upper side of the series terminal |
| 20. | Rib |
| 21. | Slot |
| 22. | Film hinge |
| 23. | label |
| 24. | Face surface |

The invention claimed is:

1. A Series terminal (1) with a common-rail connection, having an insulating housing (2) and with at least one conductor-connection element (4) and with an electrically-conducting connection rail (8), whereby the insulating housing (2) possesses at least one conductor-insertion aperture (12) for the insertion of an electrical conductor (13) to be connected and at least one actuation aperture (14) for the insertion of an actuation tool (16), characterized in that the actuation aperture (14) is formed in the insulating housing (2) by a flap that is configured for movement between a first and a second position, wherein said first position serves to close access to said actuation aperture and said second position serves to allow access to said actuation aperture.

2. A series terminal as in claim 1, characterized in that the flap (17) forms a common surface (19) with the insulating housing (2) when in said first closed position.

3. A series terminal as in claim 1, characterized in that the flap (17) consists of insulating material.

4. A series terminal as in claim 1, characterized in that the flap (17) has generally a same shape as a shape of the actuation aperture (14).

5. A series terminal as in claim 1, characterized in that the flap (17) is hingedly attached proximate one side of said flap to said insulating housing so that it may pivot.

6. A series terminal as in claim 5, characterized in that the moveable capability of the flap (17) is achieved using a film hinge (22).

7. A series terminal as in claim 1 , characterized in that an initial position of the flap (17) is determined using a mounted engagement media (18).

8. A series terminal as in claim 7, characterized in that the engagement media (18) are mounted on the flap (17) and on the actuation aperture (14).

9. A series terminal as in claim 8, characterized in that the engagement media (18) consist of a slot (21) and a rib (20).

10. A series terminal as in claim 1, characterized in that an upper surface of the flap (17) contains a symbol as a label (23) for different series terminals (1).

* * * * *